United States Patent [19]

Dormal et al.

[11] Patent Number: 4,529,525

[45] Date of Patent: Jul. 16, 1985

[54] STABILIZED ENZYME-CONTAINING DETERGENT COMPOSITIONS

[75] Inventors: Marc Dormal, Moha; Jacques Noiret, Vivegnis, both of Belgium

[73] Assignee: Colgate-Palmolive Co., New York, N.Y.

[21] Appl. No.: 412,690

[22] Filed: Aug. 30, 1982

[51] Int. Cl.[3] ..... C11D 7/42; C11D 9/00

[52] U.S. Cl. ..... 252/132; 252/108; 252/173; 252/174.12; 252/174.19; 252/122; 252/DIG. 12; 252/DIG. 14

[58] Field of Search ..... 252/173, 174.12, 174.19, 252/DIG. 12, DIG. 14, 108, 132, 122

[56] References Cited

U.S. PATENT DOCUMENTS

| | | | |
|---|---|---|---|
| 3,634,266 | 1/1972 | Theile et al. | 252/132 |
| 3,682,842 | 8/1972 | Innerfield | 252/539 |
| 4,092,273 | 5/1978 | Inamorato . | |
| 4,111,855 | 9/1978 | Barrat et al. | 252/545 |
| 4,239,552 | 12/1980 | Perner et al. | 134/28 |
| 4,243,546 | 1/1981 | Shaer | 252/174.12 |
| 4,285,841 | 8/1981 | Barrat et al. | 252/559 |
| 4,287,082 | 9/1981 | Tolfo et al. | 252/174.12 |
| 4,305,837 | 12/1981 | Kaminsky et al.* | 252/174.12 |
| 4,318,818 | 3/1982 | Letton et al. | 252/174.12 |

*Primary Examiner*—Prince E. Willis

*Attorney, Agent, or Firm*—Bernard Lieberman; Murray M. Grill; Herbert S. Sylvester

[57] ABSTRACT

A stabilized enzyme-containing liquid detergent composition is provided comprising a surfactant, calcium ion, and an enzyme which is stabilized with one or more salts of specified dicarboxylic acids. Soap is a preferred component of the detergent composition.

11 Claims, No Drawings

STABILIZED ENZYME-CONTAINING DETERGENT COMPOSITIONS

BACKGROUND OF THE INVENTION

This invention relates, in general, to stabilized aqueous enzyme compositions. More particularly, the invention relates to substantially unbuilt enzyme-containing liquid detergent compositions which provide improved enzyme stability in aqueous media and which contain saturated fatty acids and/or soaps as preferred components of the compositions.

The formulation of stable enzyme-containing liquid detergent compositions has been the focus of much attention in the prior art. The desirability of incorporating enzymes into detergent compositions is primarily due to the effectiveness of proteolytic and amylolytic enzymes in breaking down proteins and carbohydrates, thereby facilitating the removal of stains, such as gravy stains, egg stains, chocolate stains and the like, with water and detergent compounds. However, the instability of such enzymes in aqueous detergent compositions, as manifested by a rapid loss of enzyme activity during storage, is well known. Consequently, the use of enzymes in commercial liquid detergent compositions has heretofore been relatively limited.

Attempts to stabilize enzyme activity in aqueous media are extensively described in the patent literature. Among the approaches to the problem of enzyme stabilization has been the use of various organic materials, such as alcohols, polyols, esters and sugars which are said to have a stable effect upon enzymes. Water-soluble calcium salts have also been used to stabilize enzyme compositions. Thus, for example, U.S. Pat. No. 4,243,543 to Guilbert seeks to provide enzyme stability by adding an anti-oxidant and a polyol to aqueous detergent compositions, U.S. Pat. No. 4,111,855 to Barrat, et al. uses a combination of a polyacid and calcium ion as an enzyme stabilizer. U.S. Pat. No. 4,287,082 to Tolfo et al. discloses homogeneous enzyme-containing liquid detergents characterized by the presence of a saturated fatty acid, calcium ion and a specific short chain carboxylic acid. U.S. Pat. No. 4,318,818 to Letton et al. describes an enzyme composition which is stabilized by calcium ion and a short chain length carboxylic acid salt.

SUMMARY OF THE INVENTION

The present invention provides a stabilized enzyme-containing liquid detergent composition comprising: (a) from about 5 to about 75%, by weight, of one or more non-soap detergent surface active agents selected from the group consisting of anionic, nonionic, cationic, ampholytic and zwitterionic detergent compounds; (b) from about 0.1 to about 20 millimoles of calcium ion per liter of composition; (c) from about 0.05 to about 5%, by weight, of an enzyme selected from the group consisting of proteases, amylases and mixtures thereof; (d) from about 0.1 to about 10%, by weight, of a stabilizing agent comprising (i) at least one water-soluble salt of a dicarboxylic acid represented by the formula $(CH_2)n(COOH)_2$ wherein n is an integer from 1 to 6; and/or (ii) at least one water-soluble salt of an unsaturated dicarboxylic acid selected from the group consisting of fumaric acid and maleic acid; (e) from about 0 to about 25%, by weight, of a soap comprising a water-soluble salt of a saturated fatty acid having 10 to 18 carbon atoms in the alkyl chain; and (f) the balance water and optionally a sequestrant.

The non-soap surfactant mentioned above refers to detergent compounds other than soaps, the latter being highly preferred components of the present detergent compositions which for purposes of the present disclosure are categorized separately and distinctly from the other anionic surfactants. The term "soap" refers to the water-soluble salts of long chain fatty acids.

In a particularly preferred embodiment of the invention, the composition contains a soap comprising water-soluble salts of a saturated fatty acid having 12 to 14 carbon atoms in the alkyl chain, such as lauric or myristic acid, and an unsaturated fatty acid having 16 to 18 carbon atoms in the alkyl chains such as oleic acid and palmitoleic acid, and the stabilizing agent comprises a ternary mixture of the water-soluble salts of succinic acid, glutaric acid and adipic acid. The weight percent of each dicarboxylic acid salt in such ternary mixture is preferably as follows: from about 25 to 35% succinic acid, from about 25 to 35% glutaric acid and from about 25 to 35% adipic acid, each such acid being preferably present in the mixture in the form of its sodium, potassium or triethanolamine salt.

DETAILED DESCRIPTION OF THE INVENTION

The aforementioned stabilizing agent is incorporated into the liquid detergent compositions in an amount of from about 0.1 to about 10%, preferably from about 0.5 to about 5%, and more preferably from about 1 to about 5%, by weight of the composition. The stabilizing agent preferably comprises one or more sodium salts of a dicarboxylic acid represented by the formula $(CH_2)_n(COOH)_2$ wherein n is an integer from 1 to 6, such acids including malonic acid, succinic acid, glutaric acid, adipic acid, and phthalic acid. A salt of fumaric acid and/or maleic acid may also be employed as a stabilizing agent, either alone or in combination with the above-described dicarboxylic acid salts. Most preferably, the stabilizing agent comprises a ternary mixture of the sodium, potassium or triethanolamine salts of the following acids in the indicated percentages by weight: from about 25 to 35% succinic acid; from about 40 to 50% glutaric acid; and from about 25 to 35% adipic acid.

The level of calcium ion in the detergent compositions is from about 0.1 to about 20 millimoles, preferably from about 2 to 15 millimoles per liter of detergent composition. Higher levels of calcium ion are generally employed to correspond to increased amounts of soap in the detergent composition. Suitable water-soluble calcium salts which can be used as a source of calcium ion include calcium chloride, calcium acetate, calcium formate, and calcium citrate.

Soap is a preferred component of the liquid detergent compositions and is incorporated into such compositions in an amount of up to 25%, by weight, preferably from about 2 to about 20%, and most preferably from about 10 to about 18%, by weight. The useful soaps comprise the water-soluble salts of saturated fatty acids having from about 10 to 18 carbon atioms in the alkyl chain, preferably 12 to 14. Lauric acid and/or myristic acid are particularly preferred for purposes herein. The useful soaps also generally contain soluble salts of unsaturated fatty acids having from 16 to 18 carbon atoms in the alkyl chain, most notably oleic acid.

The enzymes which are suitable for use in the present invention are proteolytic enzymes and amylases. Included among the useful proteolytic enzymes are those sold under the tradenames "Alcalase" and "Esparase 8L" by Novo Industries of Copenhagen, Denmark and "Maxatase" by Gist-Brocades, the Netherlands. "Esparase 8L" is particularly preferred for use herein. An amylase enzyme may be used instead of or in addition to proteolytic enzymes, an alpha-type amalase being especially suitable for such purpose.

The pH of the detergent composition is from about 8 to 11, a pH of from about 9.5 to 10.5 being preferred for purposes of optimum enzyme stability and detergency, particularly for proteolytic enzymes. Contrary to general disclosures in the art regarding the adverse effect of an elevated pH of about 10 on enzyme stability, the compositions of the invention are markedly stable at these higher pH values. Mono-, di- and trialkanolamines can be advantageously used as pH buffers, triethanolamine, in particular being especially preferred.

The non-soap anionic class of detergents includes the water-soluble sulfated and sulfonated detergents having an alkyl radical containing from about 8 to 26, and preferably from about 12 to 22 carbon atoms. (The term "alkyl" includes the alkyl portion of the higher acyl radicals). Examples of the sulfonated anionic detergents are the higher alkyl mononuclear aromatic sulfonates such as the higher alkyl benzene sulfonates containing from about 10 to 16 carbon atoms in the higher alkyl group in a straight or branched chain, such as, for example, the sodium, potassium and ammonium salts of higher alkyl benzene sulfonates, higher alkyl toluene sulfonates and higher alkyl phenol sulfonates.

Other suitable anionic detergents are the olefin sulfonates including long chain alkene sulfonates, long chain hydroxyalkane sulfonates or mixtures of alkene sulfonates and hydroxyalkane sulfonates. The olefin sulfonate detergents may be prepared in a conventional manner by the reaction of $SO_3$ with long chain olefins containing from about 8 to 25, and preferably from about 12 to 21 carbon atoms, such olefins having the formula $RCH{=}CHR_1$ wherein R is a higher alkyl group of 6 to 23 carbons and $R_1$ is an alkyl group containing from about 1 to 17 carbon atoms or hydrogen to form a mixture of sultones and alkene sulfonic acids which is then treated to convert the sultones to sulfonates. Other examples of sulfate or sulfonate detergents are paraffin sulfonates containing from about 10 to 20 carbon atoms, and preferably from about 15 to 20 carbon atoms. The primary paraffin sulfonates are made by reacting long chain alpha olefins and bisulfites. Paraffin sulfonates having the sulfonate group distributed along the paraffin chain are shown in U.S. Pat. Nos. 2,503,280; 2,507,088; 3,260,741; 3,372,188 and German Pat. No. 735,096. Other useful sulfate and sulfonate detergents include sodium and potassium sulfates of higher alcohols containing from about 8 to 18 carbon atoms, such as, for example, sodium lauryl sulfate and sodium tallow alcohol sulfate, sodium and potassium salts of alpha-sulfofatty acid esters containing about 10 to 20 carbon atoms in the acyl group, for example, methyl alpha-sulfomyristate and methyl alphasulfotallowate, ammonium sulfates of mono- or di-glycerides of higher ($C_{10}$–$C_{18}$) fatty acids, for example, stearic monoglyceride monosulfate; sodium and alkylol ammonium salts of alkyl polyethenoxy ether sulfates produced by condensing 1 to 5 moles of ethylene oxide with 1 mole of higher ($C_8$–$C_{18}$) alcohol; sodium higher alkyl ($C_{10}$–$C_{18}$) glyceryl ether sulfonates; and sodium or potassium alkyl phennol polyethenoxy ether sulfates with about 1 to 6 oxyethylene groups per molecule and in which the alkyl radicals contain about 8 to 12 atoms.

The most highly preferred water-soluble anionic detergent compounds are the ammonium and substituted ammonium (such as mono, di and tri-ethanolamine), alkali metal (such as, sodium and potassium) and alkaline earth metal (such as, calcium and magnesium) salts of the higher alkyl benzene sulfonates, olefin sulfonates and higher alkyl sulfates. Among the above-listed anionics, the most preferred are the sodium alkyl benzene sulfonates, linear or branched (ABS).

The nonionic synthetic organic detergents are characterized by the presence of an organic hydrophobic group and an organic hydrophilic group and are typically produced by the condensation of an organic alphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups.

The nonionic detergents include the polyethylene oxide condensate of 1 mole of alkyl phenol containing from about 6 to 12 carbon atoms in a straight or branched chain configuration with about 5 to 30 moles of ethylene oxide, for example, nonyl phenol condensed with 9 moles of ethylene oxide; dodecyl phenol condensed with 15 moles of ethylene oxide; and dinonyl phenol condensed with 15 moles of ethylene oxide. Condensation products of the corresponding alkyl thiophenols with 5 to 30 moles of ethylene oxide are also suitable.

Of the above-described types of nonionic surfactants, those of the ethoxylated alcohol type are preferred. Particularly preferred nonionic surfactants include the condensation product of coconut fatty alcohol with about 6 moles of ethylene oxide per mole of coconut fatty alcohol; the condensation product of tallow fatty alcohol with about 11 moles of ethylene oxide per mole of tallow fatty alcohol; the condensation product of a secondary fatty alcohol containing about 11–15 carbon atoms with about 9 moles of ethylene oxide per mole of fatty alcohol and condensation products of more or less branched primary alcohols, whose branching is predominantly 2-methyl, with from about 4 to 12 moles of ethylene oxide.

Zwitterionic detergents such as the betaines and sulfobetaines having the following formula are also useful:

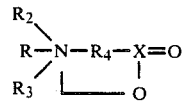

wherein R is an alkyl group containing from about 8 to 18 carbon atoms, $R_2$ and $R_3$ are each an alkylene or hydroxyalkylene group containing about 1 to 4 carbon atoms, $R_4$ is an alkylene or hydroxyalkylene group containing 1 to 4 carbon atoms, and X is C or S:O. The alkyl group can contain one or more intermediate linkages such as amido, ether, or polyether linkages or nonfunctional substituents such as hydroxyl or halogen which do not substantially affect the hydrophobic character of the group. When X is C, the detergent is called a betain; and when X is S:O, the detergent is called a sulfobetaine or sultaine.

Cationic surface active agents may also be employed. They comprise surface active detergent compounds which contain an organic hydrophobic group which forms part of a cation when the compound is dissolved in water, and an anionic group. Typical cationic surface active agents are amine and quaternary ammonium compounds.

Examples of suitable synthetic cationic detergents include: normal primary amines of the formula $RNH_2$ wherein R is an alkyl group containing from about 12 to 15 atoms; diamines having the formula $RNHC_2H_4NH_2$ wherein R is an alkyl group containing from about 12 to 22 carbon atoms, such as N-2-aminoethyl-stearyl amine and N-2-aminoethyl myristyl amine; amide-linked amine such as those having the formula $R_1CONHC_2H_4NH_2$ wherein $R_1$ is an alkyl group containing about 8 to 20 carbon atoms, such as N-2-amino ethylstearyl amide and N-amino ethylmyristyl amide; quaternary ammonium compounds wherein typically one of the groups linked to the nitrogen atom is an alkyl group containing about 8 to 22 carbon atoms and three of the groups linked to the nitrogen atom are alkyl groups which contain 1 to 3 carbon atoms, including alkyl groups bearing inert substituents, such as phenyl groups, and there is present an anion such as halogen, acetate, methosulfate, etc. The alkyl group may contain intermediate linkages such as amide which do not substantially affect the hydrophobic character of the group, for example, stearyl amido propyl quaternary ammonium chloride. Typical quaternary ammonium detergents are ethyl-dimethyl-stearyl-ammonium chloride, benzyldimethyl-stearyl ammonium chloride, trimethyl-stearyl ammonium chloride, trimethyl-cetyl ammonium bromide, dimethyl-ethyl-lauryl ammonium chloride, dimethyl-propyl-myristyl ammonium chloride, and the corresponding methosulfates and acetates.

Ampholytic detergents are also suitable for the invention. Ampholytic detergents are well known in the art and many operable detergents of this class are disclosed by A. M. Schwartz, J. W. Perry and J. Berch in "Surface Active Agents and Detergents," Interscience Publishers, New York, 1958, vol. 2. Examples of suitable amphoteric detergents include: alkyl betaiminodipropionates, $RN(C_2H_4COOM)_2$; alkyl beta-amino propionates, $RN(H)C_2H_4COOM$; and long chain imidazole derivatives having the general formula:

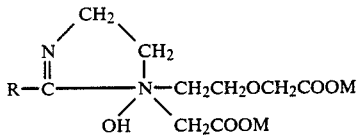

wherein in each of the above formulae R is an acyclic hydrophobic group containing from about 8 to 18 carbon atoms and M is a cation to neutralize the charge of the anion. Specific operable amphoteric detergents include the disodium salt of undecylcycloimidinium-ethoxyethionic acid-2-ethionic acid, dodecyl beta alanine, and the inner salt of 2-trimethylamino lauric acid.

Adjuvants may optionally be present in the liquid detergent compositions to provide it with additional properties, functional or aesthetic. A preferred additive is a lower alcohol having from 1 to 6 carbon atoms and 1 to 3 hydroxy groups to serve in combination with water as the solvent system for the detergent composition. Lower monoalcohols having 1 to 4 carbon atoms such as methanol, ethanol and propanol, and the lower polyols of 2 to 3 carbon atoms such as ethylene glycol and propylene glycol are most preferred as solvents for this purpose, and are generally employed in amounts of from about 2 to about 20%, by weight, of the liquid detergent composition. Such materials can also act to reduct the flash point of the liquid product as well as improve the compatibility of the solvent system with particular product components.

Sequestrants are also advantageously utilized in minor amounts in the present detergent compositions, particularly in the presence of soap and/or fatty acid salts by forming calcium complexes which are soluble in the composition. Preferred sequestrants include organic polyphosphates such as soluble salts of diethylene triamine pentamethylene phosphonic acid, and ethylene diamine tetramethylenephosphonic acid, many of such polyphosphate sequestrants being marketed by Monsanto Company under the trademark Dequest, e.g., Dequest 2000, 2041 and 2060. The sequestering agents are preferably present in amounts up to about 1%, by weight, most preferably from about 0.1 to about 0.6%.

Another category of useful additives are hydrotropes which serve to enhance the solubility in aqueous solution of components which otherwise have limited solubility in water. Useful hydrotropic materials include the alkali metal, ammonium and ethanolamine salts of acids such as benzene sulfonic acids, $C_1$–$C_5$ linear alkyl-substituted benzene sulfonic acids, e.g., toluene sulfonic acids; and xylene sulfonic acids.

The present compositions can also include conventional additives such as opacifiers, perfumes, dyes and the like, the use of which is well known in the fabric washing art.

EXAMPLE 1

Liquid detergent compositions A through Y were prepared by mixing the components shown in Tables 1 and 2 below. The stabilizing agents were used in the form of the sodium salt of the dicarboxylic acid. The parts shown for each component indicate percent by weight of the composition.

TABLE 1

| COMPOSITION | A | B | C | D | E | F | G | H | I | J | K | L |
|---|---|---|---|---|---|---|---|---|---|---|---|---|
| Sodium linear $C_{10}$–$C_{13}$ alkyl benzene sulfonate | 20 | → | → | → | → | → | → | → | → | → | → | → |
| | | (Same composition from A to L) | | | | | | | | | | |
| Ethoxylated $C_{11}$–$C_{18}$ alcohol (7 moles EO per mole alcohol) | 15 | → | → | → | → | → | → | → | → | → | → | → |
| Soap (75% lauric, 25% oleic) | 15 | → | → | → | → | → | → | → | → | → | → | → |
| Ethanol | 0 | → | → | → | → | → | → | → | → | → | → | → |

TABLE 1-continued

| COMPOSITION | A | B | C | D | E | F | G | H | I | J | K | L |
|---|---|---|---|---|---|---|---|---|---|---|---|---|
| Propylene glycol 1.2 | 12.5 | → | → | → | → | → | → | → | → | → | → | → |
| Proteolytic enyzme (a) | 0.5 | → | → | → | → | → | → | → | → | → | → | → |
| Calcium (b) | 10 | → | → | → | → | → | → | → | → | → | → | → |
| Dequest 2060 (c) | 0.3 | → | → | → | → | → | → | → | → | → | → | → |
| Na maleate | 0 | 2 | 0 | 0 | 0 | 0 | 0 | 0 | 0 | 0 | 0 | 0 |
| Na malonate | 0 | 0 | 2 | 0 | 0 | 0 | 0 | 0 | 0 | 0 | 0 | 0 |
| Na succinate | 0 | 0 | 0 | 2 | 0 | 0 | 0 | 0 | 0 | 0 | 0 | 0 |
| Na glutarate | 0 | 0 | 0 | 0 | 2 | 0 | 0 | 0 | 0 | 0 | 0 | 0 |
| Na adipate | 0 | 0 | 0 | 0 | 0 | 2 | 0 | 0 | 0 | 0 | 0 | 0 |
| Na fumarate | 0 | 0 | 0 | 0 | 0 | 0 | 2 | 0 | 0 | 0 | 0 | 0 |
| Na phthalate | 0 | 0 | 0 | 0 | 0 | 0 | 0 | 2 | 0 | 0 | 0 | 0 |
| Na tartrate | 0 | 0 | 0 | 0 | 0 | 0 | 0 | 0 | 2 | 0 | 0 | 0 |
| Na lactate | 0 | 0 | 0 | 0 | 0 | 0 | 0 | 0 | 0 | 2 | 0 | 0 |
| Na borate | 0 | 0 | 0 | 0 | 0 | 0 | 0 | 0 | 0 | 0 | 2 | 0 |
| Sokalan DCS (d) | 0 | 0 | 0 | 0 | 0 | 0 | 0 | 0 | 0 | 0 | 0 | 2 |
| Water | | | | | | Balance | | | | | | |

(a) "Esperase 8L" supplied by Novo Industry, Copenhagen, Denmark, contains about 4% enzyme.
(b) Total calcium added as calcium chloride and expressed in millimoles of calcium chloride per liter of solution.
(c) A material marketed by Monsanto Company comprising diethylene triamine pentamethylene phosphonic acid.
(d) A ternary mixture of the sodium salts of the dicarboxylic acids shown below which is marketed by BASF, West Germany, and comprises the following percentages, by weight: 25–30% succinic acid; 45–50% glutaric acid; and 25–30% adipic acid. The potassium or TEA salts provide similar enzyme stabilization.

TABLE 2

| COMPOSITION | M | N | O | P | Q | R | S | T | U | V | W | X | Y |
|---|---|---|---|---|---|---|---|---|---|---|---|---|---|
| Sodium linear $C_{10}$–$C_{13}$ alkyl benzene sulfonate | 20 | → | → | → | → | → | → | → | → | → | → | → | 10 |
| | | | (Same composition from M to X) | | | | | | | | | | |
| Ethoxylated $C_{12}$–$C_{15}$ alcohol (7 moles EO per mole alcohol) | 15 | → | → | → | → | → | → | → | → | → | → | → | 25 |
| Soap (75% lauric, 25% oleic) | 15 | → | → | → | → | → | → | → | → | → | → | → | 10 |
| Ethanol | 9 | → | → | → | → | → | → | → | → | → | → | → | 0 |
| Propylene glycol 1.2 | 3.5 | → | → | → | → | → | → | → | → | → | → | → | 6 |
| Proteolytic enyzme (a) | 0.5 | → | → | → | → | → | → | → | → | → | → | → | 0.5 |
| Calcium (b) | 10 | → | → | → | → | → | → | → | → | → | → | → | 10 |
| Dequest 2060 (c) | 0.3 | → | → | → | → | → | → | → | → | → | → | → | 0.3 |
| Na maleate | 0 | 2 | 0 | 0 | 0 | 0 | 0 | 0 | 0 | 0 | 0 | 0 | 0 |
| Na malonate | 0 | 0 | 2 | 0 | 0 | 0 | 0 | 0 | 0 | 0 | 0 | 0 | 0 |
| Na succinate | 0 | 0 | 0 | 2 | 0 | 0 | 0 | 0 | 0 | 0 | 0 | 0 | 0 |
| Na glutarate | 0 | 0 | 0 | 0 | 2 | 0 | 0 | 0 | 0 | 0 | 0 | 0 | 0 |
| Na adipate | 0 | 0 | 0 | 0 | 0 | 2 | 0 | 0 | 0 | 0 | 0 | 0 | 0 |
| Na fumarate | 0 | 0 | 0 | 0 | 0 | 0 | 2 | 0 | 0 | 0 | 0 | 0 | 0 |
| Na phthalate | 0 | 0 | 0 | 0 | 0 | 0 | 0 | 2 | 0 | 0 | 0 | 0 | 0 |
| Na tartrate | 0 | 0 | 0 | 0 | 0 | 0 | 0 | 0 | 2 | 0 | 0 | 0 | 0 |
| Na lactate | 0 | 0 | 0 | 0 | 0 | 0 | 0 | 0 | 0 | 2 | 0 | 0 | 0 |
| Na borate | 0 | 0 | 0 | 0 | 0 | 0 | 0 | 0 | 0 | 0 | 2 | 0 | 0 |
| Sokalan DCS (d) | 0 | 0 | 0 | 0 | 0 | 0 | 0 | 0 | 0 | 0 | 0 | 2 | 2 |
| Water | | | | | | | Balance | | | | | | |

(a), (b), (c), (d) - See footnotes Table 1

The enzyme stability of compositions A through Y was determined under storage conditions at 43° C. for a period of seven days. The residual enzyme activity was determined at the end of the period for each composition, the results being shown below.

| Residual Enzymatic Activity in % After Seven days at 43° C. | |
|---|---|
| Composition A | 50 |
| Composition B | 80 |
| Composition C | 80 |
| Composition D | 80 |
| Composition E | 80 |
| Composition F | 80 |
| Composition G | 80 |
| Composition H | 80 |
| Composition I | 80 |
| Composition J | 90 |
| Composition K | 80 |
| Composition L | 80 |
| Composition M | 30 |
| Composition N | 60 |
| Composition O | 60 |
| Composition P | 70 |
| Composition Q | 55 |

-continued

| Residual Enzymatic Activity in % After Seven days at 43° C. | |
|---|---|
| Composition R | 70 |
| Composition S | 60 |
| Composition T | 55 |
| Composition U | 60 |
| Composition V | 60 |
| Composition W | 60 |
| Composition X | 70 |
| Composition Y | 80 |

As seen from the data above, compositions A through L are comprised of identical compositions except for the presence of a stabilizing agent in accordance with the invention. The compositions are free of a lower monohydric alcohol and employ propylene glycol as a solvent. Compositions B through L, each of which contains a stabilizing agent, manifest a significant improvement in enzyme stability relative to composition A, a composition not in accordance with the invention. Similarly, compositions M through X are comprised of identical compositions which contain as a solvent a mixture of ethanol and propylene glycol, and all of which except for composition M contain a stabilizing agent as described herein. As seen from Table 2, the enzyme stability is significantly enhanced in compositions N through X relative to composition M. Composition Y represents another monoalcohol-free liquid detergent composition which is effectively stabilized in accordance with the invention.

What is claimed is:

1. A stabilized enzyme-containing liquid detergent composition comprising:

(a) from about 5 to about 75%, by weight, of one or more non-soap detergent surface active agents selected from the group consisting of anionic, nonionic, cationic, ampholytic and zwitterionic detergent compounds;

(b) a water soluble calcium salt in an amount sufficient to provide from about 0.1 to about 20 millimoles of calcium ion per liter of composition;

(c) from about 0.05 to about 5%, by weight, of an enzyme selected from the group consisting of proteases, amylases and mixtures thereof;

(d) from about 0.1 to about 10%, by weight, of a stabilizing agent comprising a ternary mixture from about 25% to 35% of succinate acid; from about 40 to 50% of glutaric acid; and from about 25 to 35% of adipic acid;

(e) from about 0% to about 25%, by weight, of a soap comprising a water soluble salt of a saturated fatty acid having 10 to 18 carbon atoms in the alkyl chain; and (f) the balance water.

2. The composition in accordance with claim 1 which contains from about 2 to about 20%, by weight, of said soap.

3. The composition in accordance with claim 1 wherein the soap additionally contains water soluble salts of unsaturated fatty acids having from 16 to 18 carbon atoms in the alkyl chain.

4. The composition in accordance with claim 3 which contains from about 10 to about 18%, by weight, of a soap comprising about 75%, by weight, of a water soluble salt of lauric acid and about 25%, by weight, of a water soluble salt of oleic acid.

5. The composition in accordance with claim 1 wherein the level of calcium ion is about 10 millimoles per liter.

6. The composition in accordance with claim 1 wherein the detergent surfactant is a mixture of a non-soap anionic detergent compound and a nonionic detergent compound.

7. The composition in accordance with claim 1 wherein the pH of the detergent composition is from about 8 to 11.

8. The composition in accordance with claim 1 which contains from about 0.1 to about 1% of an organic polyphosphonate sequestrant.

9. The composition in accordance with claim 1 which contains from about 2 to about 20%, by weight, of a solvent selected from the group consisting of a lower monoalcohol having 1 to 4 carbon atoms; a lower polyol having 2 to 3 carbon atoms and mixtures thereof.

10. The composition in accordance with claim 9 wherein said solvent is a mixture of ethanol and propylene glycol.

11. The composition in accordance with claim 1 which additionally contains a sequestering agent.

* * * * *